US010174605B2

(12) United States Patent
Cune et al.

(10) Patent No.: US 10,174,605 B2
(45) Date of Patent: Jan. 8, 2019

(54) ISOLATING MULE SHOE

(71) Applicant: LORD Corporation, Cary, NC (US)

(72) Inventors: Gregg Cune, Conroe, TX (US); Jonathan Chukinas, West Chester, PA (US); John P. Smid, Cypress, TX (US)

(73) Assignee: LORD Corporation, Cary, NC (US)

( * ) Notice: Subject to any disclaimer, the term of this patent is extended or adjusted under 35 U.S.C. 154(b) by 167 days.

(21) Appl. No.: 15/112,841

(22) PCT Filed: Jan. 23, 2015

(86) PCT No.: PCT/US2015/012620
§ 371 (c)(1),
(2) Date: Jul. 20, 2016

(87) PCT Pub. No.: WO2015/112821
PCT Pub. Date: Jul. 30, 2015

(65) Prior Publication Data

US 2016/0369615 A1 Dec. 22, 2016

Related U.S. Application Data

(60) Provisional application No. 61/931,264, filed on Jan. 24, 2014.

(51) Int. Cl.

| | |
|---|---|
| ***E21B 47/01*** | (2012.01) |
| ***E21B 17/07*** | (2006.01) |
| *E21B 47/024* | (2006.01) |

(52) U.S. Cl.
CPC ..... *E21B 47/011* (2013.01); *E21B 17/07* (2013.01); *E21B 47/024* (2013.01)

(58) Field of Classification Search
CPC ..... E21B 17/07; E21B 47/011
See application file for complete search history.

(56) References Cited

U.S. PATENT DOCUMENTS

| | | | |
|---|---|---|---|
| 4,094,360 | A | 6/1978 | Nelson |
| 4,130,162 | A | 12/1978 | Nelson |
| 4,186,569 | A | 2/1980 | Aumann |
| 4,265,305 | A | 5/1981 | Stone et al. |
| 4,825,421 | A | 4/1989 | Jeter |
| 5,073,877 | A | 12/1991 | Jeter |
| 7,673,705 | B2 | 3/2010 | Gearhart et al. |
| 2009/0014166 | A1 | 1/2009 | Cheeseborough |
| 2011/0061934 | A1 | 3/2011 | Jekielek |
| 2011/0186284 | A1 | 8/2011 | Jekielek |
| 2012/0247832 | A1 | 10/2012 | Cramer et al. |
| 2013/0025886 | A1 | 1/2013 | Martinez et al. |
| 2013/0140019 | A1 | 6/2013 | Pare et al. |

*Primary Examiner* — David J Bagnell
*Assistant Examiner* — Kristyn A Hall

(57) ABSTRACT

Systems and methods are disclosed that include providing an isolating mule shoe having an integrated axial isolator coupled to a landing sleeve of a drill string at an upper end of the axial isolator. The axial isolator includes an elastomeric component that is coupled between a first component and a second component. The first component and the second component are configured to displace axially with respect to one another as a result of a force imparted upon the landing sleeve to provide vibration control.

8 Claims, 8 Drawing Sheets

ISOLATING MULE SHOE

CROSS REFERENCE TO RELATED APPLICATIONS

The present application claims the benefit of U.S. Provisional Patent Application Ser. No. 61/931,264, filed Jan. 24, 2014, the disclosure of which is incorporated herein by reference in its entirety.

BACKGROUND

In some hydrocarbon recovery systems, electronics and/or other sensitive hardware may be included in a drill string. In some cases, a drill string may be exposed to both repetitive vibrations comprising a relatively consistent frequency and vibratory shocks that alternatively may not be repetitive. Each of the repetitive vibrations and shock vibrations may damage and/or otherwise interfere with operation of the electronics, such as, but not limited to, measurement while drilling (MWD) devices and/or logging while drilling (LWD) devices, and/or any other vibration sensitive device of a drill string. While some electronic devices are packaged in vibration resistant housings, in some cases the vibration resistant housings are not capable of protecting the electronic devices against both the repetitive and shock vibrations. In some cases, active vibration isolation systems are provided to isolate the electronics from harmful vibration but the active vibration isolation systems are expensive. Further, many hydrocarbon recovery systems employ universal bottom hole orientation (UBHO) subs in combination with a complementary alignment hub in order to establish and maintain a downhole tool orientation relative to the wellbore. The alignment hub is sometimes referred to as a landing sleeve and/or a mule shoe, and the alignment hubs are generally axially rigid so that repetitive vibrations and shock vibrations are not significantly damped by the alignment hub and/or the UBHO sub.

SUMMARY

In some embodiments of the disclosure, an isolating mule shoe is disclosed as comprising: a landing sleeve; and an axial isolator coupled to the landing sleeve, the axial isolator comprising: an upper external adapter; an upper inner sleeve; an upper shear unit coupled to an outer surface of the upper inner sleeve and coupled to an inner surface of the external adapter; a lower external adapter; a lower inner sleeve axially coupled to the upper inner sleeve; and a lower shear unit coupled to an outer surface of the lower inner sleeve and coupled to an inner surface of the external adapter.

In other embodiments of the disclosure, an isolating mule shoe is disclosed as comprising: a landing sleeve; an axial isolator coupled to the landing sleeve, the axial isolator comprising: an isolator module; and a universal bottom hole orientation (UBHO) adapter axially coupled to the isolator module and configured to receive at least a portion of the isolator module within a substantially conical bore, wherein at least a portion of the isolator module received within the substantially conical bore is bonded to at least a portion of the substantially conical bore via an elastomeric material.

In yet other embodiments of the disclosure, a method of reducing vibration in a drill string is disclosed as comprising: providing an isolating mule shoe having an axial vibration damper comprising a first component, a second component, and at least one elastomeric component disposed between the first component and the second component; coupling axially the axial vibration damper to a landing sleeve of the drill string; imparting a force from the landing sleeve to the first component of the axial vibration damper; and displacing axially the second component with respect to the second component.

DETAILED DESCRIPTION

In some cases, it is desirable to provide a passive isolator for a drill string that protects electronics and other sensitive equipment from repetitive vibrations and/or shock vibrations. It may also be desirable to provide an isolator configured to axially isolate the above-described vibration sensitive components from vibrations over a large frequency range. In some cases, an isolator may be tuned and/or otherwise configured to isolate the vibration sensitive component from frequencies as low as about 1 Hz to about 50 Hz, about 5 Hz to about 25 Hz, about 10 Hz to about 20 Hz, or about 15 Hz. However, in some embodiments, the isolator may be very stiff and have a natural frequency between about 10 Hz and about 200 Hz. Accordingly, in such embodiments, the isolator may be tuned and/or otherwise configured to isolate the vibration sensitive component from frequencies higher than between about 110 Hz and about 200 Hz. In some embodiments, even though an isolator is configured to effectively isolate the above-described relatively low frequencies, the same isolators may also effectively isolate the vibration sensitive components from frequencies much higher, such as hundreds and/or even thousands of Hertz. In other words, an isolator configured to protect vibration sensitive components from low frequency vibrations may also protect vibration sensitive components from high frequency vibrations. In some embodiments of the disclosure, systems and methods are disclosed that provide an isolator comprising a passive, relatively soft (i.e. relatively long settling time) spring-mass system configured to have a natural frequency less than 0.7 times a selected anticipated excitation frequency. In some embodiments, the above-described isolator may include two or more axial displacement elements, each of which provide force transmission paths in series with each other, and each of which are axially movable to selectively alter an overall length of the isolator in response to a vibratory and/or shock input to the isolator.

Figure 1:
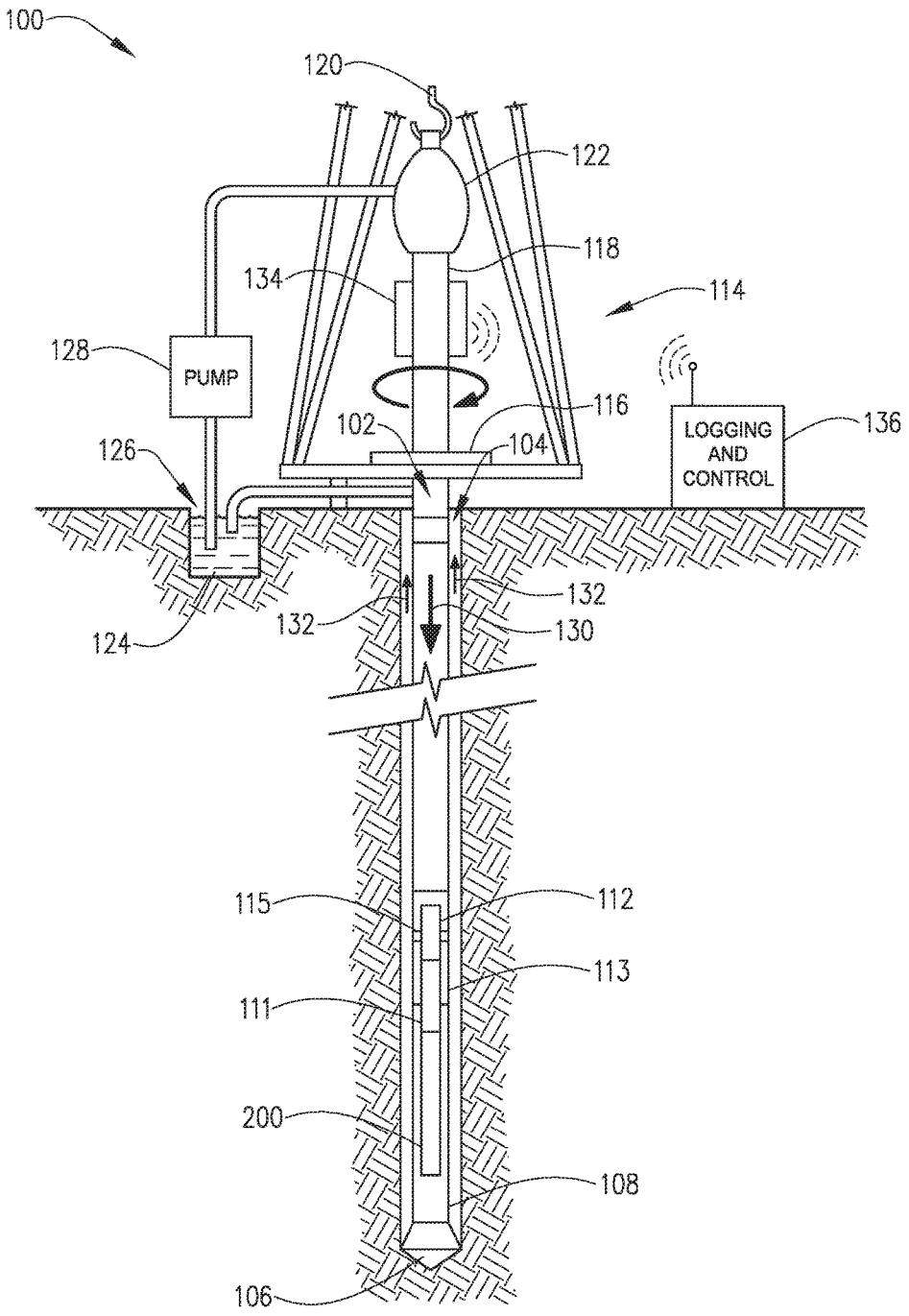
FIG. 1 is a schematic view of a hydrocarbon recovery system.

Referring now to FIG. 1, a schematic view of a hydrocarbon recovery system 100 is illustrated. The hydrocarbon recovery system 100 may be onshore or offshore recovery system. The hydrocarbon recovery system 100 comprises a drill string 102 suspended within a borehole 104. The drill string 102 comprises a drill bit 106 at the lower end of the drill string 102 and a universal bottom-hole orientation (UBHO) sub 108 connected above the drill bit 106. The UBHO sub 108 comprises an isolating mule shoe 200 configured to connect with an axial end of a stinger or pulser helix 111 on a top side of the isolating mule shoe 200. The hydrocarbon recovery system 100 further comprises an electronics casing 113 connected to a top side of the UBHO sub 108. The electronics casing 113 may at least partially house the stinger or pulser helix 111, electronic components 112, and/or centralizers 115. The hydrocarbon recovery system 100 comprises a platform and derrick assembly 114 positioned over the borehole 104 at the surface. The derrick assembly 114 comprises a rotary table 116 which engages a kelly 118 at an upper end of the drill string 102 to impart rotation to the drill string 102. The drill string 102 is suspended from a hook 120 that is attached to a traveling block (not shown). The drill string 102 is positioned through the kelly 118 and the rotary swivel 122 which permits rotation of the drill string 102 relative to the hook 120. Additionally or alternatively, a top drive system (not shown) may be used to impart rotation to the drill string 102.

In some cases, the hydrocarbon recovery system 100 further comprises drilling fluid 124 which may comprise a water-based mud, an oil-based mud, a gaseous drilling fluid, water, gas, and/or any other suitable fluid for maintaining bore pressure and/or removing cuttings from the area surrounding the drill bit 106. Some drilling fluid 124 may be stored in a pit 126, and a pump 128 may deliver the drilling fluid 124 to the interior of the drill string 102 via a port in the rotary swivel 122, causing the drilling fluid 124 to flow downwardly through the drill string 102 as indicated by directional arrow 130. After exiting the UBHO sub 108, the drilling fluid 124 may exit the drill string 102 via ports in the drill bit 106 and circulate upwardly through the annular region between the outside of the drill string 102 and the wall of the borehole 104 as indicated by directional arrows 132. The drilling fluid 124 may lubricate the drill bit 106, carry cuttings from the formation up to the surface as it is returned to the pit 126 for recirculation, and create a mudcake layer (e.g., filter cake) on the walls of the borehole 104. In some embodiments, the hydrocarbon recovery system 100 may further comprise an agitator and/or any other vibratory device configured to vibrate, shake, and/or otherwise change a position of an end of the drill string 102 and/or any other component of the drill string 102 relative to the wall of the borehole 104. In some cases, operation of an agitator may generate oscillatory movement of selected portions of the drill string 102, so that the drill string 102 is less likely to become hung or otherwise prevented from advancement into and/or out of the borehole 104. In some embodiments, low frequency oscillations of the agitator may have values of about 5 Hz to about 100 Hz.

The hydrocarbon recovery system 100 further comprises a communications relay 134 and a logging and control processor 136. The communications relay 134 may receive information and/or data from sensors, transmitters, and/or receivers located within the electronic components 112 and/or other communicating devices. The information may be received by the communications relay 134 via a wired communication path through the drill string 102 and/or via a wireless communication path. The communications relay 134 may also transmit the received information and/or data to the logging and control processor 136, and the communications relay 134 may also receive data and/or information from the logging and control processor 136. Upon receiving the data and/or information, the communications relay 134 may forward the data and/or information to the appropriate sensor(s), transmitter(s), and/or receiver(s) of the electronic components 112 and/or other communicating devices. The electronic components 112 may comprise measuring while drilling (MWD) and/or logging while drilling (LWD) devices. The electronic components 112 may be provided in multiple tools or subs and/or a single tool and/or single sub. In other embodiments, different conveyance types, including, coiled tubing, wireline, wired drill pipe, and/or any other suitable conveyance type may be alternatively utilized.

Figure 2:
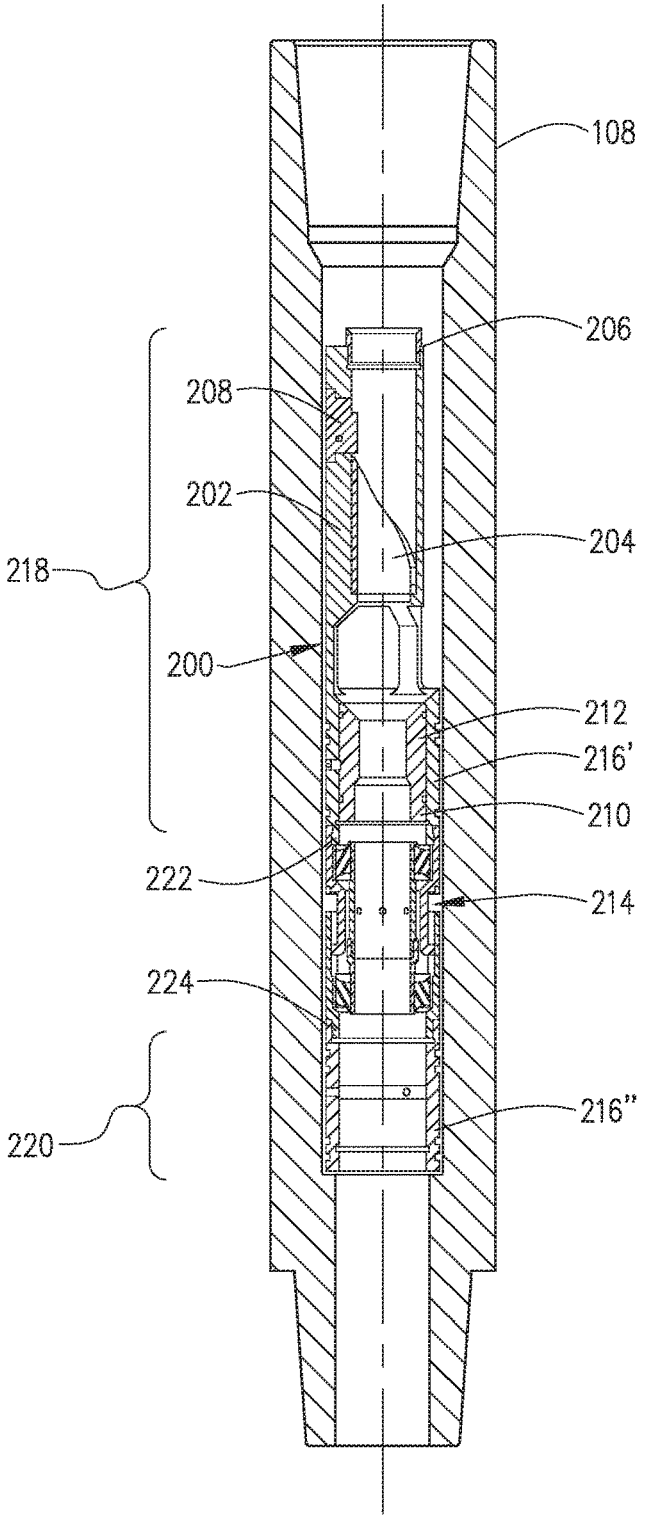
FIG. 2 is a cross-sectional view of an isolating mule shoe of the hydrocarbon recovery system of FIG. 1.

Referring now to FIG. 2, a cross-sectional view of the isolating mule shoe 200 disposed within the UBHO sub 108 is shown. The isolating mule shoe 200 comprises a housing 202, a pulser helix interface 204, a wear cuff 206, an alignment key 208, a bottom sleeve 210 having an orifice 212, an axial isolator 214, and a UBHO adapter 216. The isolating mule shoe 200 is configured to provide the functionality of a conventional mule shoe as well as axial vibration and/or axial shock damping functionality. In some cases, the isolating mule shoe 200 may comprise a landing sleeve 218 and a mule shoe lower 220, the axial isolator 214 being connected axially between the landing sleeve 218 and the mule shoe lower 220. In some cases, the landing sleeve 218 comprises at least a portion of the housing 202 that houses the pulser helix interface 204, the pulser helix interface 204, and the alignment key 208. The mule shoe lower 220 comprises at least the UBHO adapter 216". In some embodiments, the landing sleeve 218 may comprise substantially all of a conventional mule shoe, including a UBHO adapter 216'. Further, in some embodiments, the mule shoe lower 220 may comprise only a UBHO adapter of a conventional mule shoe that may be manufactured separately from the first conventional mule shoe and/or alternatively cut from a second conventional mule shoe. Regardless of the manner in which the components of the isolating mule shoe 200 are created and/or sourced, the upper end of the isolating mule shoe 200 may provide substantially the same fluid and/or force path connectivity and/or functionality as the upper end of a conventional mule shoe while the lower end of the isolating mule shoe 200 may provide substantially the same fluid and/or force path connectivity and/or functionality as the lower end of a conventional mule shoe. In the embodiment shown in FIG. 2, the landing sleeve 218 comprises substantially the entirety of a first conventional mule shoe. However, the lower end of the first conventional mule shoe may be machined and/or otherwise reconfigured to provide an upper adapter feature 222, such as, but not limited to, a reduced diameter portion comprising threads for mating to complementary threads of the upper end of the axial isolator 214. Further, in the embodiment shown in FIG. 2, the mule shoe lower 220 comprises substantially only a UBHO adapter of a second conventional mule shoe, and the upper end of the UBHO adapter of the second conventional mule shoe may be machined and/or otherwise reconfigured to provide a lower adapter feature 224, such as, but not limited to, a reduced wall thickness portion comprising threads for mating to complementary threads of the lower end of the axial isolator 214. As such, the entirety of the isolating mule shoe 200 may be constructed by adapting two already existing conventional mule shoes and connecting the adapted conventional mule shoes or portions thereof, axially above and axially below the axial isolator 214.

Figure 3:
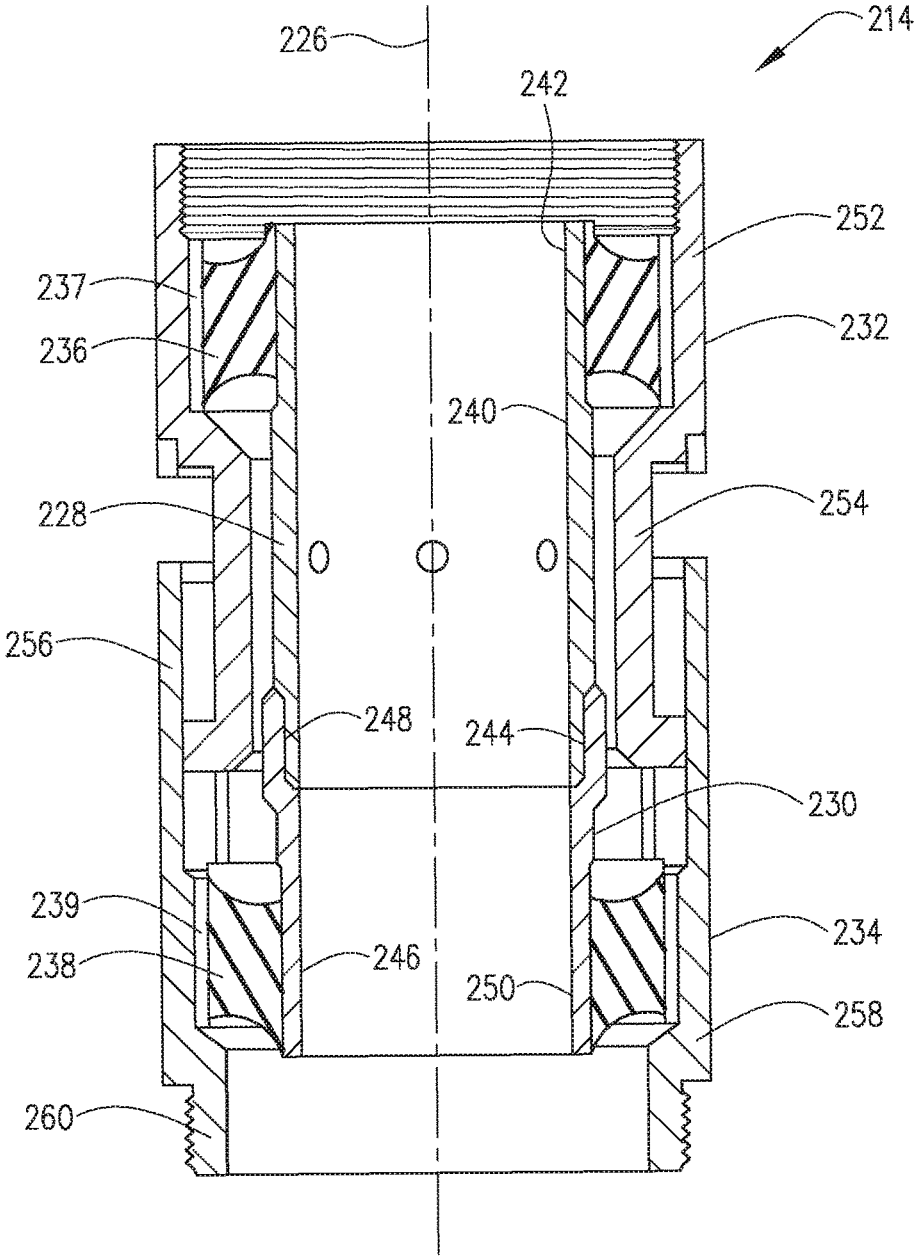
FIG. 3 is a cross-sectional view of an axial isolator of the isolating mule shoe of FIG. 2.

Referring now to FIG. 3, a cross-sectional view of the axial isolator 214 of the isolating mule shoe 200 of FIG. 2 is shown. The axial isolator 214 generally comprises a central axis 226 with which many of the components of the axial isolator 214 are substantially aligned coaxially. The axial isolator 214 further comprises an upper inner tube 228, a lower inner tube 230, an upper external adapter 232, a lower external adapter 234, an upper shear unit 236, and a lower shear unit 238. The upper inner tube 228 comprises a substantially consistent inner bore 240 through which drilling fluids may pass. The upper inner tube 228 further comprises an upper reduced outer diameter section 242 and a lower reduced outer diameter section 244. The lower inner tube 230 comprises a substantially consistent lower bore section 246 through which drilling fluids may pass and a relatively larger diameter upper bore section 248. Generally, the lower reduced outer diameter section 244 of the upper inner tube 228 is connected by an interference fit, such as, but not limited to, a press fit to the upper bore section 248 of the lower inner tube 230. In alternative embodiments, the lower reduced outer diameter section 244 of the upper inner tube 228 may be connected to the upper bore section 248 of the lower inner tube 230 via sets of complementary threads and/or any other suitable connection. Accordingly, axial movement of the upper inner tube 228 and the lower inner tube 230 may be substantially synchronized. The lower inner tube 230 further comprises a lower reduced outer diameter section 250. In this embodiment, an inner surface of the upper shear unit 236 is attached to the upper reduced outer diameter section 242 of the upper inner tube 228, and an inner surface of the lower shear unit 238 is attached to the lower reduced outer diameter section 250.

In this embodiment, the shear units 236, 238 are formed of an elastomeric material, such as, but not limited to, rubber (e.g., nature rubber) and/or nitrile. In alternative embodiments, one or more portions of the shear units 236, 238 may comprise any other suitable elastically deformable material and/or composite structure. In yet other alternative embodiments, the shear units 236, 238 may comprise dissimilar shear moduli so that the force required to shear one portion of the shear units 236, 238 may be insufficient to shear another portion of the shear units 236, 238, so that the shear units 236, 238 may provide a non-linear and/or a tiered response to shearing forces substantially parallel to the central axis 226. By increasing a distance between the shear units 236, 238, the shear units 236, 238 may increasingly prevent cocking and/or off axis alignment of the components of the axial isolator 214 with respect to the central axis 226.

The upper external adapter 232 comprises an upper inner diameter section 252 and a lower inner diameter section 254 that comprises a relatively smaller inner diameter as compared to the upper inner diameter section 252. An outer surface of the upper shear unit 236 is attached to an inner wall of the upper inner diameter section 252, so that the upper inner tube 228 is generally movably attached to the upper external adapter 232. In some embodiments, the upper shear unit 236 may comprise a substantially rigid ring 237, shim, and/or other suitable outer component that may be used to secure the upper shear unit 236 to the inner wall of the upper inner diameter section 252 via an interference fit, such as, but not limited to, a press fit. In this embodiment, a substantial portion of the upper inner tube 228 is located coaxially within the lower inner diameter section 254, and the amount of axial overlap between the two may vary as a function of the relative axial displacement between the two that is allowed by the upper shear unit 236.

The lower external adapter 234 generally comprises an upper inner diameter section 256, a middle inner diameter section 258, and a lower inner diameter section 260. The upper inner diameter section 256 comprises an inner diameter that is larger than the inner diameter of the middle inner diameter section 258. The middle inner diameter section 258 comprises an inner diameter that is larger than inner diameter of the lower inner diameter section 260. In this embodiment, the lower shear unit 238 is attached to an inner wall of the middle inner diameter section 258, so that the lower inner tube 230 is generally movably attached to the lower external adapter 234. In some embodiments, the lower shear unit 238 may comprise a substantially rigid ring 239, shim, and/or other suitable outer component that may be used to secure the lower shear unit 238 to the inner wall of the middle inner diameter section 258 via an interference fit, such as, but not limited to, a press fit. In this embodiment, a substantial portion of the lower inner tube 230 is located coaxially within the middle inner diameter section 258, and the amount of axial overlap between the two may vary as a function of the relative axial displacement between the two that is allowed by the lower shear unit 238. Further, the upper inner diameter section 256 generally movably receives at least a portion of the lower inner diameter section 254 of the upper external adapter 232 so that an amount of axial overlap between the two may vary as a function of the relative axial displacement allowed by the shear units 236, 238.

In operation, when the axial isolator 214 is coupled with a mass to be isolated (i.e. electronic components 112 and/or more generally an isolated mass), the axial isolator 214 provides a relatively soft (relatively long settling time) spring mass system that operates to isolate the electronic components 112 from selected frequencies of vibrational perturbations. While in some embodiments, the isolated mass (i.e. the electronic components 112) may weigh about 150 pounds, in alternative embodiments, the electronic components 112 and/or any other components that together comprise a mass to be isolated by the isolator 200 may comprise any other suitable weight. In particular, the upper external adapter 232 may receive disturbing axial input forces (e.g. compressive forces and/or tension forces) from the landing sleeve 218. The force may be transferred from the upper external adapter 232 to the upper inner tube 228 via the upper shear unit 236. To the extent that the upper shear unit 236 allows axial displacement of the upper inner tube 232, the upper inner tube 228 and the attached lower inner tube 230 may be free to axially displace in response to a compressive force input until an axial mechanical interference occurs. Similarly, the lower external adapter 234 may receive disturbing axial input forces (e.g. compressive forces and/or tension forces) from the mule shoe lower 220. The force may be transferred from the lower external adapter 234 to the lower inner tube 230 via the lower shear unit 238. To the extent that the lower shear unit 238 allows axial displacement of the lower inner tube 230, the lower inner tube 230 and the attached upper inner tube 228 may be free to axially displace in response to a compressive force input until an axial mechanical interference occurs. Flexure of the shear units 236, 238 may result in movement of the lower external adapter 234 either toward or away from the electronic components 112, depending on the axial direction and magnitude of the input forces. Accordingly, sufficient upward or compressive forces applied to the lower external adapter 234 may result in a foreshortening of an overall length of the axial isolator 214 and/or isolating mule shoe 200. Similarly, sufficient downward or tension forces applied to the lower external adapter 234 may result in a lengthening of an overall length of the axial isolator 214 and/or isolating mule shoe 200. The above-described force transfer path between the upper external adapter 232 and the lower external adapter 234 comprises two serially connected soft transfer paths, each comprising a shear unit.

Figure 4:
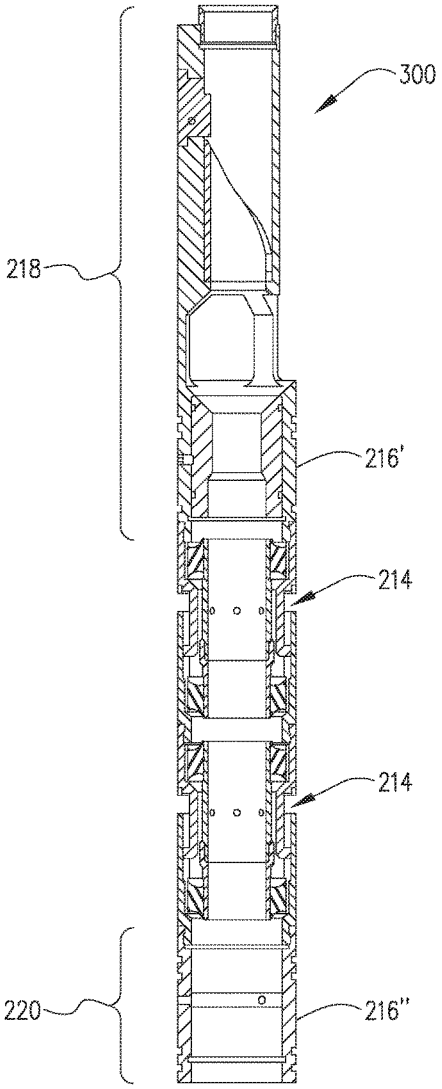
FIG. 4 is a cross-sectional view of an alternative embodiment of an isolating mule shoe.

Referring now to FIG. 4, a cross-sectional view of an alternative embodiment of an isolating mule shoe 300 is shown. The isolating mule shoe 300 is substantially similar to the isolating mule shoe 200 but with a primary difference being that the isolating mule shoe 300 comprises two axial isolators 214 connected to each other serially and between the landing sleeve 218 and the mule shoe lower 220.

Figure 5:
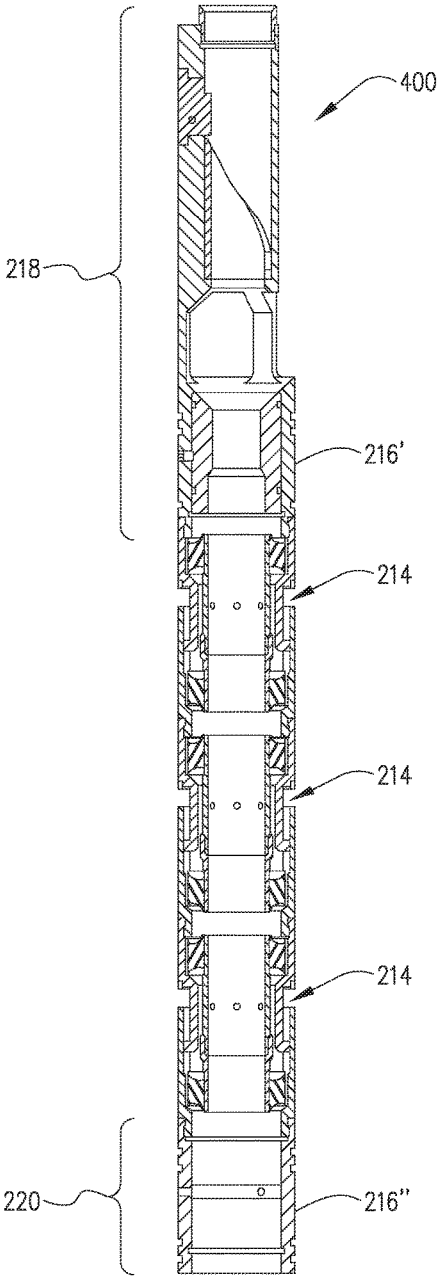
FIG. 5 is a cross-sectional view of another alternative embodiment of an isolating mule shoe.

Referring now to FIG. 5, a cross-sectional view of an alternative embodiment of an isolating mule shoe 400 is shown. The isolating mule shoe 400 is substantially similar to the isolating mule shoe 200 but with a primary difference being that the isolating mule shoe 400 comprises three axial isolators 214 connected to each other serially and between the landing sleeve 218 and the mule shoe lower 220.

Figure 6:
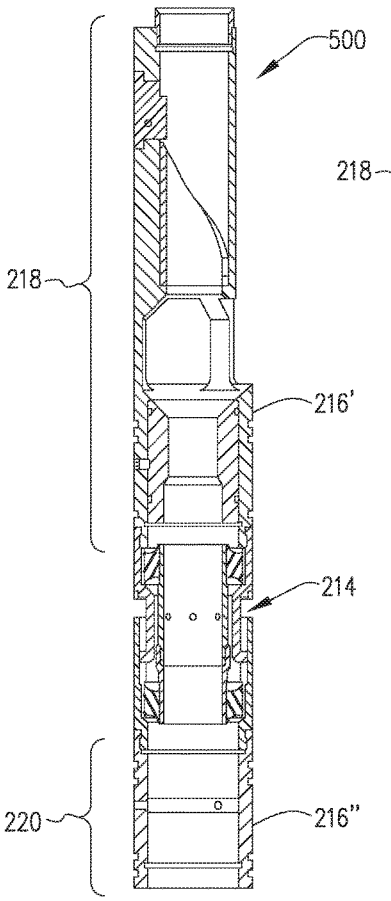
FIG. 6 is a cross-sectional view of another alternative embodiment of an isolating mule shoe.

Referring now to FIG. 6, a cross-sectional view of an alternative embodiment of an isolating mule shoe 500 is shown. The isolating mule shoe 500 is substantially similar to the isolating mule shoe 200 but with a primary difference being that the isolating mule shoe 500 comprises a landing sleeve 218 constructed of an existing conventional mule shoe, including a UBHO adapter 216' while the mule shoe lower 220 comprises a newly created UBHO adapter 216''' that was not cut from and/or separated from an already existing conventional mule shoe. Instead, the UBHO adapter 216''' may be different from the UBHO adapter 216' and the mule shoe lower 220 may generally comprise new components.

Figure 7:
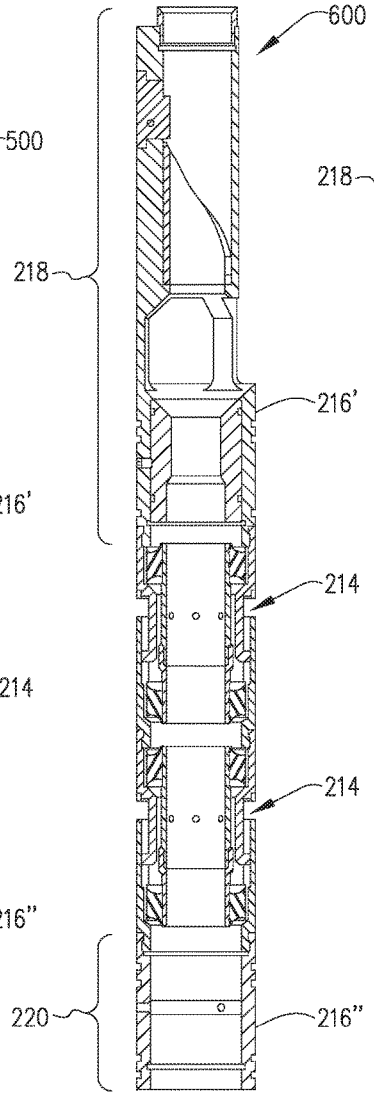
FIG. 7 is a cross-sectional view of another alternative embodiment of an isolating mule shoe.

Referring now to FIG. 7, a cross-sectional view of an alternative embodiment of an isolating mule shoe 600 is shown. The isolating mule shoe 600 is substantially similar to the isolating mule shoe 500 but with a primary difference being that the isolating mule shoe 600 comprises two axial isolators 214 connected to each other serially and between the landing sleeve 218 and the mule shoe lower 220.

Figure 8:
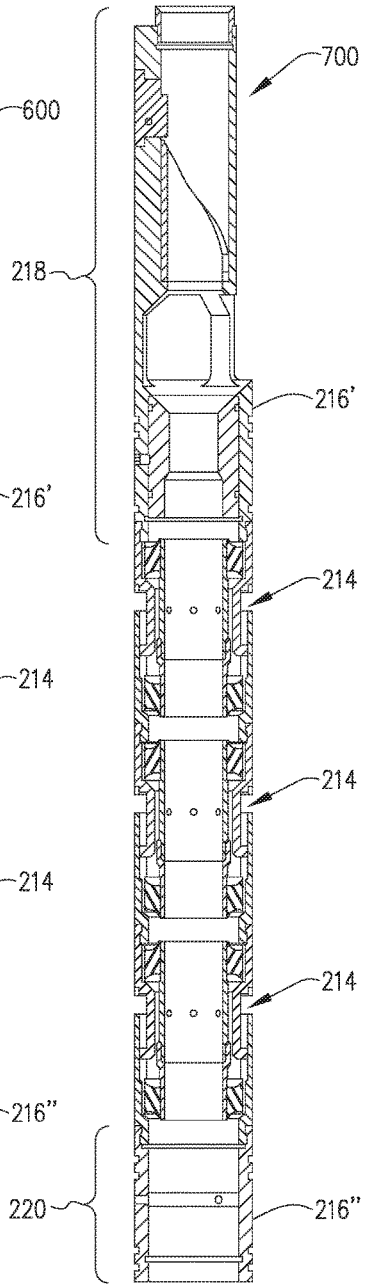
FIG. 8 is a cross-sectional view of another alternative embodiment of an isolating mule shoe.

Referring now to FIG. 8, a cross-sectional view of an alternative embodiment of an isolating mule shoe 700 is shown. The isolating mule shoe 700 is substantially similar to the isolating mule shoe 500 but with a primary difference being that the isolating mule shoe 700 comprises three axial isolators 214 connected to each other serially and between the landing sleeve 218 and the mule shoe lower 220.

Figure 9C:
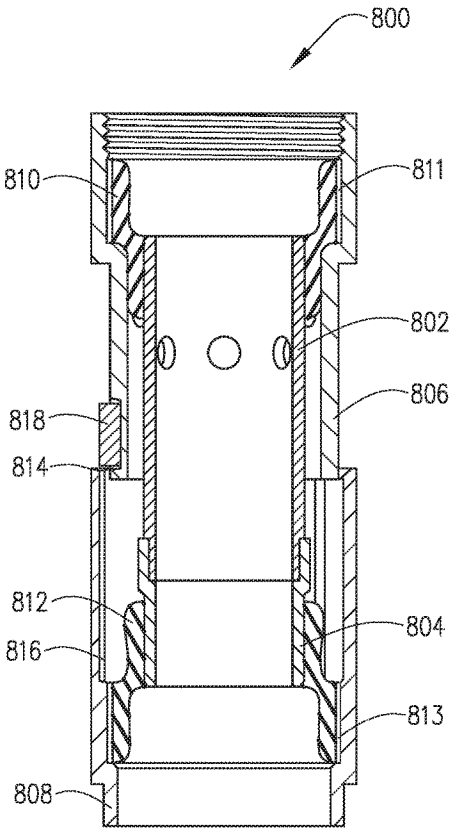
FIGS. 9A-9C are cutaway views of an alternative embodiment of an axial isolator in a maximum compressed state, a relaxed state, and a maximum extended and/or tension state, respectively.
Figure 9B:
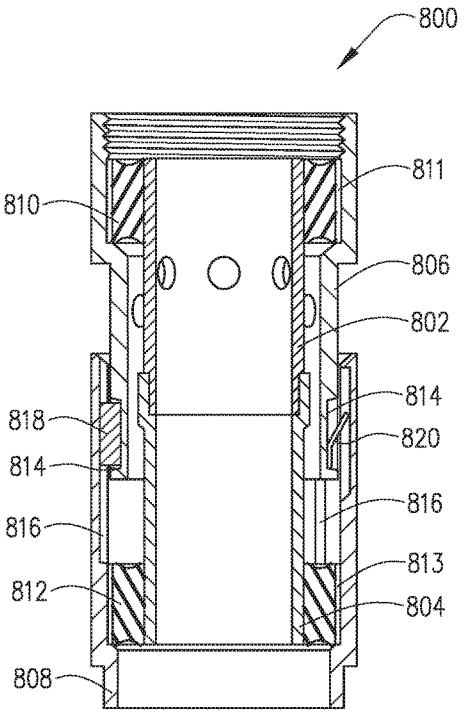
Figure 9A:
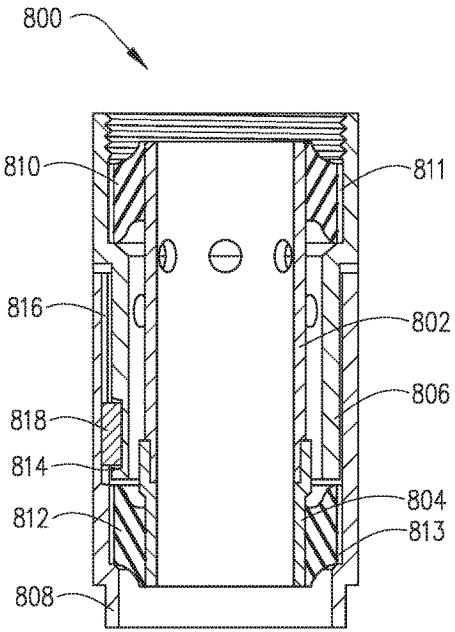

Referring now to FIGS. 9A-9C, cutaway views of an alternative embodiment of an axial isolator 800 are shown with the axial isolator 800 in a maximum compressed state, a relaxed state, and a maximum extended and/or tension state, respectively. The axial isolator 800 is substantially similar to axial isolator 214 and comprises an upper inner tube 802, a lower inner tube 804, an upper external adapter 806, a lower external adapter 808, an upper shear unit 810, and a lower shear unit 812. Similar to the shear units 236, 238, the upper shear unit 810 and the lower shear unit 812 comprise substantially rigid rings 811, 813, respectively, that may be used to secure the upper shear unit 810 to an inner wall of the upper external adapter 806 and to secure the lower shear unit 812 to an inner wall of the lower external adapter 808 via an interference fit, such as, but not limited to, a press fit. A plurality of concavities 814 are located on an exterior surface of the upper external adapter 806, and a plurality of corresponding longitudinal channels 816 are located on an interior surface of the lower external adapter 808. The concavities 814 are each configured to receive a cylindrical pin 818 in a manner that substantially retains a longitudinal position of the pin 818 relative to the upper external adapter 806. The longitudinal channels 816 are each configured to receive at least a portion of a cylindrical pin 818, so that pins 818 are disposed between the lower portion of the upper external adapter 806 and the upper portion of the lower external adapter 808 when the lower portion of the upper external adapter 806 is received within the upper portion of the lower external adapter 808. When the pins 818 are disposed between the lower portion of the upper external adapter 806 and the upper portion of the lower external adapter 808, within the concavities 814, and within the channels 816, the pins 818 serve to prevent axial rotation of the upper external adapter 806 relative to the lower external adapter 808 while allowing longitudinal displacement of the upper external adapter 806 relative to the lower external adapter 808. In some embodiments, a flexible and/or biased stop 820 may be carried in a concavity 814 and configured to engage a wall of the lower external adapter 808 to restrict removal of the upper external adapter 806 from the lower external adapter 808.

Figure 10:
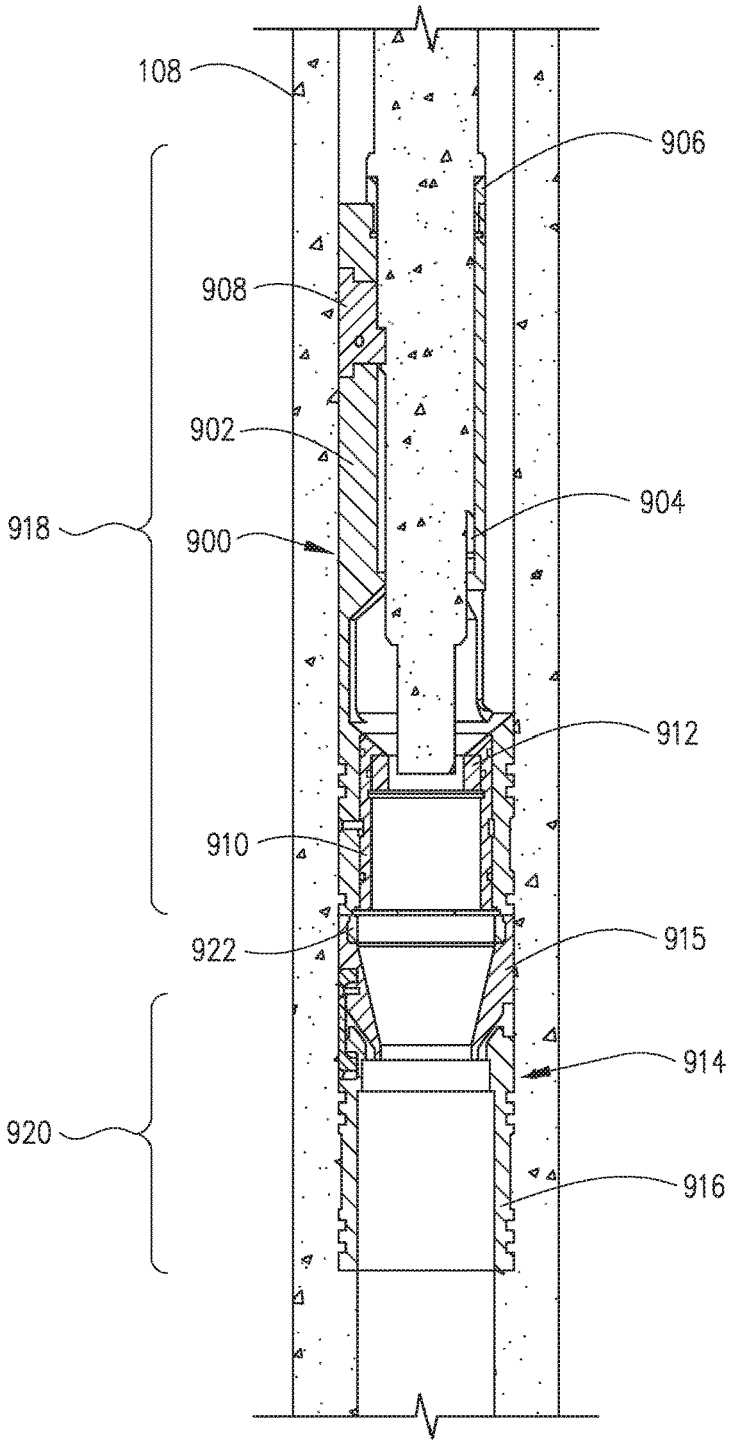
FIG. 10 is a cross-sectional view of another alternative embodiment of an isolating mule shoe.

Referring now to FIG. 10, a cross-sectional view of an alternative embodiment of an isolating mule shoe 900 is shown. The isolating mule shoe 900 is substantially similar to the isolating mule shoe 200 in that the isolating mule shoe 900 includes a housing 902, a pulser helix interface 904, a wear cuff 906, an alignment key 908, a bottom sleeve 910 having an orifice 912, an axial isolator 914 having an isolator module 915 and a universal bottom hole orientation (UBHO) adapter 916. In some embodiments, the isolating mule shoe 900 comprises a landing sleeve 918 that comprises at least a portion of the housing 902 that houses the pulser helix interface 904, the pulser helix interface 904, the alignment key 908, and the bottom sleeve 910. In some embodiments, the isolating mule shoe 900 also comprises a mule shoe lower 920 that comprises at least the UBHO adapter 916. Further, it will be appreciated that the isolating mule shoe 900 may also be used in the UBHO sub 108 in a substantially similar fashion to the isolating mule shoe 200. While the isolating mule shoe 900 is configured to provide the functionality of a conventional mule shoe as well as axial vibration and/or axial shock damping functionality substantially similarly to the isolating mule shoe 200, the main difference between the isolating mule shoe 900 and the isolating mule shoe 200 is that the axial isolator 914 incorporates the UBHO adapter 916 of the isolating mule shoe 900. The isolating module 915 and the UBHO adapter 916 are joined (i.e. bonded together) to form a substantially single component which may result in the axial isolator 914 and/or the isolating mule shoe 900 having a much more rigid and/or stiffer construction. Accordingly, the isolator module 915 and the UBHO adapter 916 are connected axially to the landing sleeve 918 such that the isolator module 915 is disposed between the landing sleeve 918 and the UBHO adapter 916. To join the axial isolator 914 to landing sleeve 918, a lower end of the landing sleeve 918 may comprise an upper adapter feature 922, such as, but not limited to, a reduced diameter portion comprising threads for mating to complementary threads of an upper end of the isolator module 915 of the axial isolator 914. Alternatively, the upper adapter feature 922 may comprise a reduced diameter portion for press-fitting into a complementary upper end of the isolator module 915 of the axial isolator 914.

Figure 11:
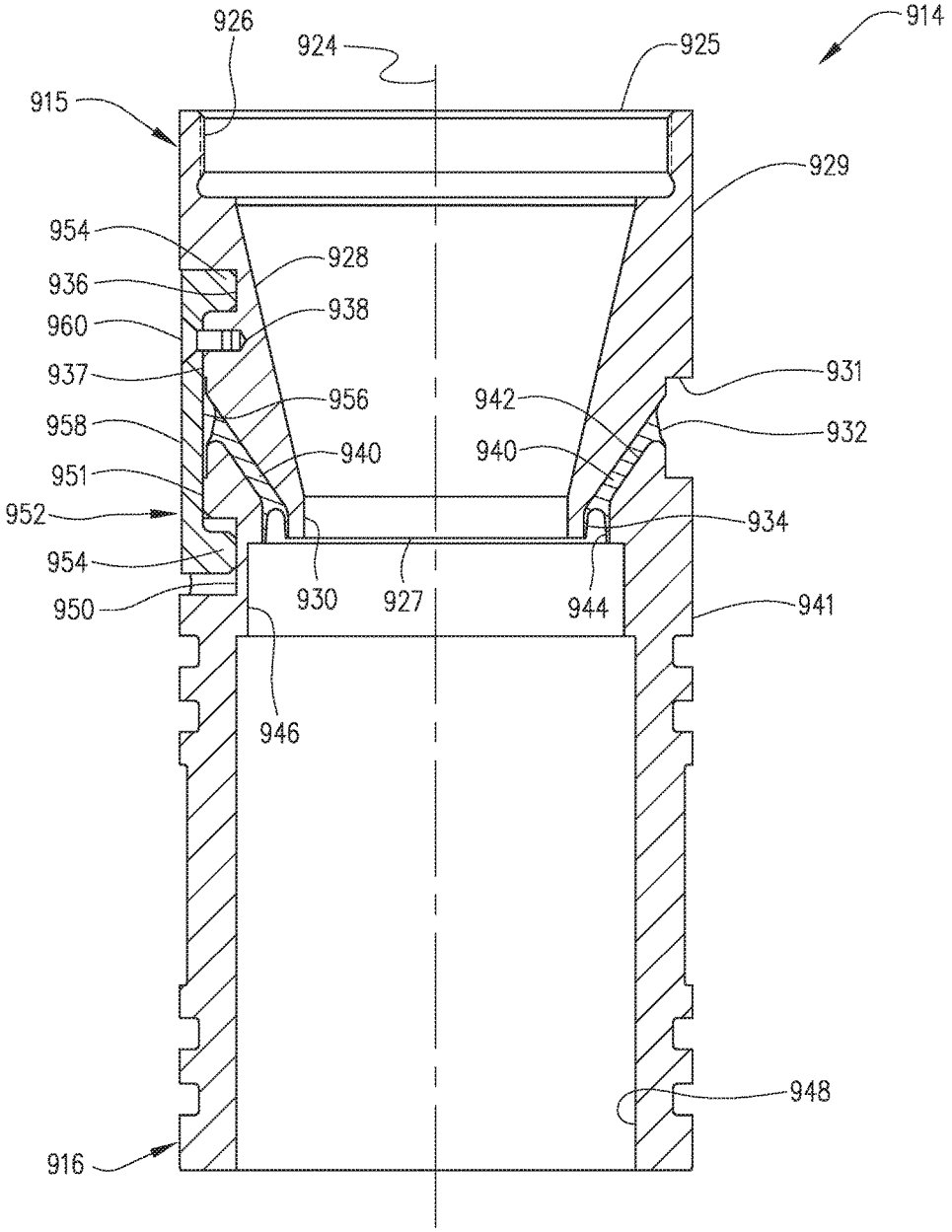
FIG. 11 is a cross-sectional view of the axial isolator of the isolating mule shoe of FIG. 10.

Referring now to FIG. 11, a cross-sectional view of the axial isolator 914 of the isolating mule shoe 900 of FIG. 10 is shown. The axial isolator 914 generally comprises a central axis 924 with which many of the components of the axial isolator 914, such as the isolator module 915 and the UBHO adapter 916, are substantially coaxially aligned. The isolator module 915 includes an upper end 925 that comprises a receiving portion 926 having a recess for receiving the upper adapter feature 922 of the landing sleeve 918. The receiving portion 926 also comprises complementary threads to the upper adapter feature 922 so that the isolator module 915 may be threaded onto the upper adapter feature 922 of the landing sleeve 918. The isolator module 915 comprises a substantially conical central bore 928 that extends from the receiving portion 926 and terminates at a substantially cylindrical central bore 930 that extends between a lower end of the substantially conical central bore 928 to a lower end 927 of the isolator module 915.

The isolator module 915 also includes an outer surface 929. In some embodiments, the outer surface 929 may comprise a substantially similar diameter to a largest outer diameter of the landing sleeve 918. However, in other embodiments, the outer surface 929 may comprise a diameter that can be accepted by the UBHO sub 108. The isolator module 915 also includes an outer conical surface 932 and a substantially cylindrical outer surface 934 having a reduced diameter relative to the outer surface 929. The substantially cylindrical outer surface 934 extends from the lower end 927 of the isolator module 915 and terminates at the outer conical surface 932. The substantially cylindrical outer surface 934 may be substantially concentric with the substantially cylindrical central bore 930. In some embodiments, the substantially cylindrical outer surface 934 comprises a substantially similar length as measured along the central axis 924 as the substantially cylindrical central bore 930. However, in other embodiments, the substantially cylindrical outer surface 934 may not extend from the lower end 927 as far as the substantially cylindrical central bore 930 extends as measured along the central axis 924. In some embodiments, the outer conical surface 932 may extend between the substantially cylindrical outer surface 934 and the outer surface 929. However, in other embodiments, the outer conical surface 932 may extend between the substantially cylindrical outer surface 934 and other geometric features, including, but not limited to, a recess 931.

The UBHO adapter 916 includes an outer surface 941. In some embodiments, the outer surface 941 may comprise a substantially similar diameter to the outer surface 929 of the axial isolator 914 and/or the largest outer diameter of the landing sleeve 918. The UBHO adapter 916 includes a substantially conical counterbore 942 and a substantially cylindrical counterbore 944. The substantially conical counterbore 942 extends from an upper end of the UBHO adapter 916 and terminates at an upper end of the substantially cylindrical counterbore 944. The substantially conical counterbore 942 may be configured at a complementary angle to the outer conical surface 932 with respect to the central axis 924. The substantially conical counterbore 942 may also be configured to receive at least a portion of the outer conical surface 932, while the substantially cylindrical counterbore 944 is configured to receive at least a portion of the substantially cylindrical outer surface 934 of the isolator module 915. The UBHO adapter 916 also includes a first enlarged central bore 946 and a second enlarged central bore 948 that have a substantially cylindrical bore shape. The first enlarged central bore 946 extends from a lower end of the substantially cylindrical counterbore 944 and has a larger diameter than the substantially cylindrical counterbore 944. The second enlarged central bore 948 extends from a lower end of the first enlarged central bore 946 through the remainder of the UBHO adapter 916 and has a larger diameter than the first enlarged central bore 946.

Generally, the isolator module 915 and the UBHO adapter 916 of the axial isolator 914 of the isolating mule shoe 900 are joined together to form a substantially single component. More specifically, the isolator module 915 and the UBHO adapter 916 are bonded together by applying an elastomeric material 940 between at least the outer conical surface 932 of the isolator module 915 and the substantially conical counterbore 942 of the UBHO adapter 916. In some embodiments, the elastomeric material 940 may also be applied between the substantially cylindrical outer surface 934 of the isolator module 915 and the substantially cylindrical counterbore 944 of the UBHO adapter 916 to bond the isolator module 915 to the UBHO adapter 916. The elastomeric material 940 may include, but is not limited to, rubber (e.g., natural rubber) and/or nitrile. In alternative embodiments, the elastomeric material 940 may comprise any other suitable elastically deformable material and/or composite structure capable of bonding the isolator module 915 to the UBHO adapter 916.

The isolator module 915 and the UBHO adapter 916 also include a plurality of catch tabs 952. The catch tabs 952 are generally configured to restrict rotation between the isolator module 915 and the UBHO adapter 916. In some embodiments, the isolator module 915 and the UBHO adapter 916 may use three catch tabs 952. In alternative embodiments, more or fewer catch tabs 952 may be used. Each catch tab 952 includes a key 954 disposed at each of a lower end and an upper end of the catch tab 952, an inner surface 956, and an outer surface 958. The catch tabs 952 may generally form a substantially U-shaped profile, such that the keys 954 extend inward from the inner surface 956 towards the central axis 924 at each of the upper end and the lower end of the catch tab 952. The catch tab 952 may extend over at least a portion of the isolator module 915 and the UBHO adapter 916. For each of the plurality of catch tabs 952, the isolator module 915 and the UBHO adapter 916 may each comprise a key slot 936, 950 and recessed surface 937, 951, respectively, for receiving the catch tab 954. More specifically, the isolator module 915 includes a key slot 936 for receiving the key 954 of the upper end of the catch tab 952 and the UBHO adapter 916 includes a key slot 950 for receiving the key 954 of the lower end of the catch tab 952. Additionally, the isolator module 915 includes a recessed surface 937 that is configured to abut a portion of the inner surface 956 of the catch tab 952, and the UBHO adapter 916 includes a recessed surface 951 that also is configured to abut a portion of the inner surface 956 of the catch tab 952. The recessed surfaces 937, 951 are configured at a depth such that the outer surface 958 of the catch tab 952 does not extend further from the central axis 924 than either of the outer surfaces 929, 941 of the isolator module 915 and the UBHO adapter, respectively.

The isolator module 915 also includes a fastener hole 938 that is configured to receive a fastener 960 that holds each catch tab 952 to the isolator module 915. Additionally, each of the key slots 950 in the UBHO adapter 916 may be larger than the key 954 at the lower end of the catch tab 952 such that the key 954 at the lower end of the catch tab 952 may slide within the key slot 950 of the UBHO adapter 916 to allow a longitudinal displacement of the UBHO adapter 916 along the central axis 924 with respect to each of the isolator module 915 and the catch tabs 952. In alternative embodiments, the UBHO adapter 916 may include the fastener hole 938 that is configured to receive a fastener 960 that holds each catch tab 952 to the UBHO adapter 916. Additionally, in such alternative embodiments, each of the key slots 936 in the isolator module 915 may be larger than the key 954 at the upper end of the catch tab 952 such that the key 954 at the upper end of the catch tab 952 may slide within the key slot 936 of the isolator module 915 to allow a longitudinal displacement of the isolator module 915 along the central axis 924 with respect to each of the UBHO adapter 916 and the catch tabs 952. It will be appreciated that the fastener 960 may comprise a screw, a pin and retaining ring, a weld, a rivet, or any other suitable fastening device capable of fastening the catch tabs 952 to either of the isolator module 915 and the UBHO adapter 916.

In operation, when the axial isolator 914 is coupled with a mass to be isolated (i.e. electronic components 112 and/or more generally an isolated mass), the isolator module 915 and the UBHO adapter 916 bonded together by the elastomeric material 940 to form the axial isolator 914, provide a relatively soft (relatively long settling time) spring mass system that operates to isolate the electronic components 112 from selected frequencies of vibrational perturbations. More specifically, the isolator module 915 may receive disturbing axial input forces (e.g. compressive forces and/or tension forces) from the landing sleeve 918. The force may be transferred from the isolator module 915 through the elastomeric material 940 to the UBHO adapter 916. To the extent that the isolator module 915 allows axial displacement of the UBHO adapter 916 as described herein, the UBHO adapter 916 may be free to axially displace in response to a compressive force input until an axial mechanical interference occurs (via the keys 954 of the catch tabs 952 and the key slots 936, 950). Similarly, the isolator module 915 may receive disturbing axial input forces (e.g. compressive forces and/or tension forces) from the UBHO adapter 916. The force may be transferred from the UBHO adapter 916 through the elastomeric material 940 to the isolator module 915. Flexure of the elastomeric material 940 may result in movement of the UBHO adapter 916 either toward or away from the isolator module 915 and consequently the electronic components 112, depending on the axial direction and magnitude of the input forces. Accordingly, sufficient upward or compressive forces may result in a foreshortening of an overall length of the isolating mule shoe 900. Similarly, sufficient downward or tension forces may result in a lengthening of an overall length of the isolating mule shoe 900.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. An isolating mule shoe, comprising:

a landing sleeve;

an axial isolator coupled to the landing sleeve, the axial isolator comprising:

an isolator module; and a universal bottom hole orientation (UBHO) adapter axially coupled to the isolator module and configured to receive at least a portion of the isolator module within a substantially conical bore, wherein at least a portion of the isolator module received within the substantially conical bore is bonded to at least a portion of the substantially conical bore via an elastomeric material.

2. The isolating mule shoe of claim 1, wherein the isolator module comprises a substantially conical bore.

3. The isolating mule shoe of claim 1, wherein the isolator module comprises an outer conical surface that is complimentary to the substantially conical bore of UBHO adapter.

4. The isolating mule shoe of claim 3, wherein the elastomeric material is disposed between the outer conical surface of the isolator module and the substantially conical bore of the UBHO adapter.

5. The isolating mule shoe of claim 4, wherein the elastomeric material is configured to allow axial displacement of the isolator module with respect to the UBHO adapter.

6. The isolating mule shoe of claim 1, wherein the isolating mule show comprises a plurality of catch tabs configured to restrict rotation between the isolator module and UBHO adapter.

7. The isolating mule shoe of claim 6, wherein each of the isolator module and the UBHO adapter comprise a key slot for receiving a key of each of the plurality of catch tabs.

8. The isolating mule shoe of claim 7, wherein at least one of the isolator module and the UBHO adapter key slots is configured to allow axial displacement of the isolator module with respect to the UBHO adapter.

* * * * *